US005342037A

United States Patent [19]

Martin

[11] Patent Number: 5,342,037

[45] Date of Patent: Aug. 30, 1994

[54] FEED ROLL WEAR COMPENSATION SCHEME

[75] Inventor: Kathleen M. Martin, Hamlin, N.Y.

[73] Assignee: Xerox Corporation, Stamford, Conn.

[21] Appl. No.: 168,288

[22] Filed: Dec. 17, 1993

[51] Int. Cl.[5] ..... B65H 1/08; B65H 3/06

[52] U.S. Cl. ..... 271/111; 271/121; 271/126; 271/147

[58] Field of Search ..... 271/110, 111, 121-125, 271/126, 127, 147

[56] References Cited

U.S. PATENT DOCUMENTS

| | | | |
|---|---|---|---|
| 3,866,903 | 2/1975 | Eppe et al. | 271/119 |
| 4,331,328 | 5/1982 | Fasig | 271/111 X |
| 4,919,412 | 4/1990 | Weigel | 271/110 |
| 5,121,915 | 6/1992 | Duncan | 271/111 |
| 5,149,077 | 9/1992 | Martin et al. | 271/18.3 |
| 5,186,449 | 2/1993 | Ohmi | 271/111 X |
| 5,195,736 | 3/1993 | Ishidate | 271/122 X |
| 5,197,726 | 3/1993 | Nogami | 271/110 |
| 5,201,508 | 4/1993 | Kuo | 271/111 X |

*Primary Examiner*—Richard A. Schacher

[57] ABSTRACT

A feed roll wear compensating method and apparatus measures the surface speed of the feed and nudger rolls that are rotated by a motor and adjusts the motor speed to prevent sheet damage from occurring. The surface speed of each of the rolls is measured by sensors that detect the position of a moving sheet and the signal from the sensors is used to deduce the reduction in diameter of the rolls due to wear. The roll wear information is used to adjust the nominal elevator height to maintain constant force on the sheets and to provide feedback for adaptive control of the feed motor to adjust the speed of the feed roll.

4 Claims, 4 Drawing Sheets

FEED ROLL WEAR COMPENSATION SCHEME

This invention is directed generally to friction retard feeders, and more particularly, to an improved feed roll wear compensation scheme for use in such feeders.

Traditionally, in friction retard feeder, nudger rolls are employed to move the top substrate(s) from a stack to a retard mechanism as a result of a net frictional force. The retard mechanism sometimes includes a feed roll positioned above a retard roll forming a nip that allows a single substrate at a time to pass through the mechanism. Some nudger rolls are constructed from an elastomeric material. These rolls have a failure mode of loss of a suitably high friction coefficient due to contamination, dirt build-up and wear. In fact, in friction retard feeders, a common cause of failure roll wear. As the feed, nudger and retard rolls wear, the surface speed of each increases. If the wear rates of each of these roll is different, the roll speeds will not be the same, causing sheets to buckle or tear as they pass through the paper path of a copier/printer. If there is a large enough speed mismatch, a sheet can be damaged and a misfeed will occur. Changes in roll diameter also affect the force of each roll on the sheets. If the nudger roll in a feeder wears, while the stack height stays constant, the normal force on the sheets decreases. This too may cause misfeeds. If the roll diameter is known, the height of an elevator or other mechanism that maintains the height of the sheets in a stack can be adjusted to maintain constant normal force on the sheets.

Attempts at overcoming nudger roll deficiencies include U.S. Pat. No. 3,866,903 which discloses a sheet feeding apparatus that delivers a top sheet of a stack to advancing rolls by using a cylindrical sleeve comprised of an elastomeric material with a high coefficient of friction. The sleeve is rotated by a drive to move the top sheet towards the advancing rolls. A hybrid nudger roll is disclosed in U.S. Pat. No. 5,149,077 for use in a friction retard feeder that includes alternating elastomeric and studded rolls positioned on a support shaft. The outer surface of the elastomeric rolls extends beyond the tips of the studded rolls, but when the elastomeric rolls are deformed against a stack of sheets due to normal force, the tips of the studded rolls extends beyond the outer surface of the elastomeric rolls. Even with availability of the above-mentioned nudger rolls, the need still exists for a retard feed system the compensates for roll wear in order to minimize misfeeds.

Accordingly, in an aspect of this invention, a friction retard feeder roll wear compensating method and apparatus is disclosed that measures the surface speed of the friction retard, feed and nudger rolls that are rotated by a motor and adjusts the motor speed to prevent sheet damage from occurring. The surface speed of each of the rolls is measured by sensors that detect the position of a moving sheet and the signal from the sensors is used to deduce the reduction in diameter of the rolls due to wear. The roll wear information is used to adjust the nominal elevator height to maintain constant force of the nudger roll on the sheets and to provide feedback for adaptive control of the feed motor to thereby control the speed of the feed roll in order to prevent tearing of sheets.

The foregoing and other features of the instant invention will be apparent from a further reading of the specification, claims and from the drawings in which:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
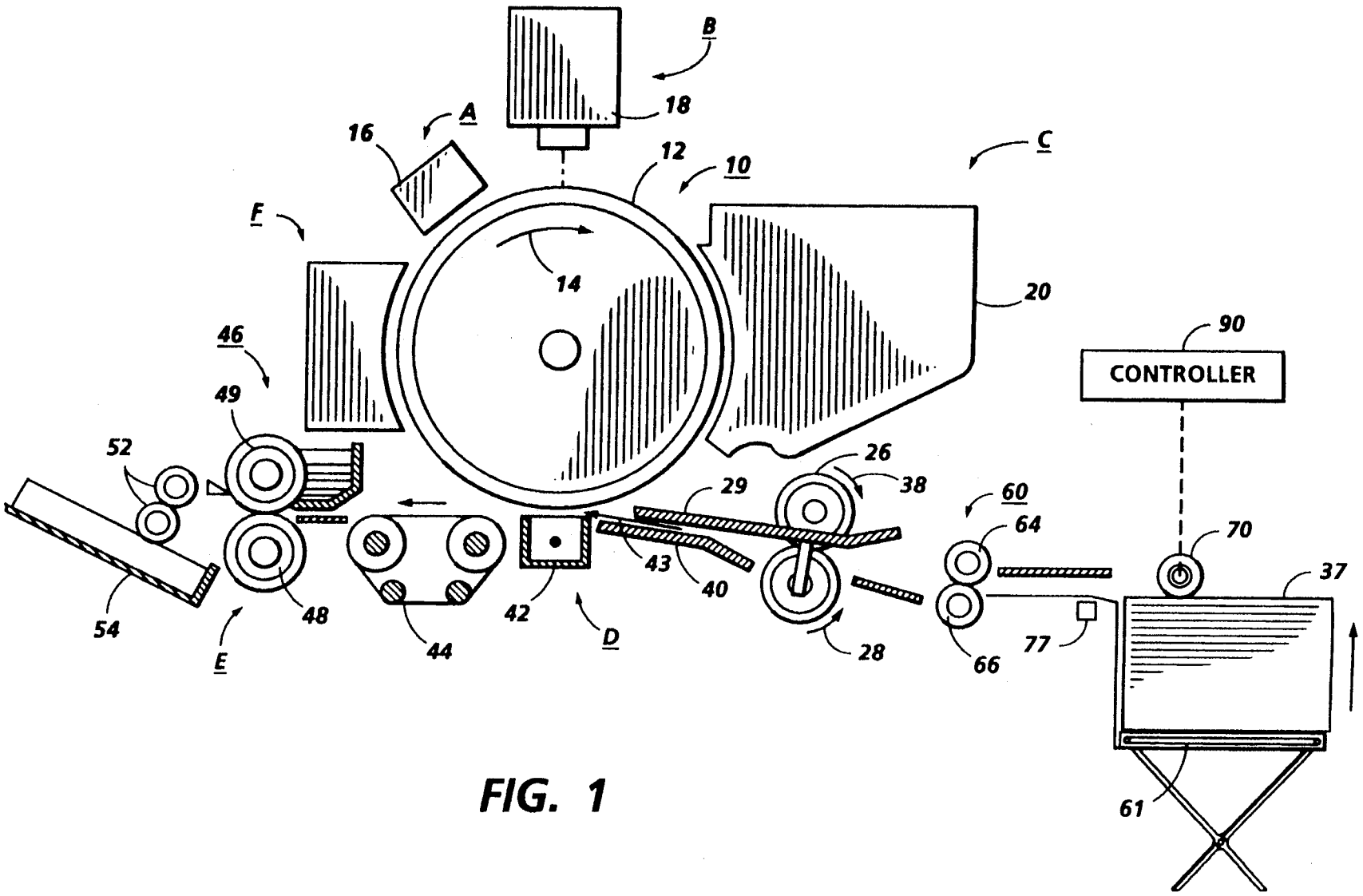
FIG. 1 is a schematic elevational view of an electrophotographic printing machine incorporating the features of one aspect of the present invention.

For a general understanding of an electrophotographic printing machine in which the features of the present invention may be incorporated, reference is made to FIG. 1 which depicts schematically the various components thereof. Hereinafter, like reference numerals will be employed throughout to designate identical elements. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in this application to the particular embodiment shown herein.

Since the practice of electrophotographic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 entrained about and secured to the exterior circumferential surface of a conductive substrate is rotated in the direction of arrow 14 through the various processing stations. By way of example, photoconductive surface 12 may be made from selenium. A suitable conductive substrate is made from aluminum.

Initially, drum 10 rotates a portion of photoconductive surface 12 through charging station A. Charging station A employs a conventional corona generating device, indicated generally by the reference numeral 16, to charge photoconductive surface 12 to a relatively high substantially uniform potential.

Thereafter drum 10 rotates the charged portion of photoconductive surface 12 to expose station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the informational areas contained within the original document. Obviously, electronic imaging of page image information could be used, if desired.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic material with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by retard sheet feeding apparatus 60 to transfer station D. Nudger roll 70 of sheet feeding apparatus 60 is controlled by controller 90 and advances one or more copy sheets to a retard nip formed by drive roll 64 and retard roll 66. Retard roll 66 applies a retarding force to shear any multiple sheets from the sheet being fed and forwards it to registration roller 24 and idler roller 26. Registration roller 24 is driven by a motor (now shown) in the direction of arrow 28 and idler roller 26 rotates in the direction of arrow 38 since roller 24 is in contact therewith. In operation, feed device 60 operates to advance the uppermost sheet from a stack of sheets 36 into registration rollers 24 and 26 and against registration fingers 22. Fingers 22 are actuated by conventional means in timed relation to an image on drum 12 such that the sheet resting against the fingers is forwarded toward the drum in synchronism with the image of the drum. The sheet is advanced in the direction of arrow 43 through a chute formed by guides 29 and 40 to transfer station D.

Continuing now with the various processing stations, transfer station D includes a corona generating device 42 which applies a spray of ions to the back side of the copy sheet. This attracts the toner powder image from photoconductive surface 12 to copy sheet.

After transfer of the toner powder image to the copy sheet, the sheet is advanced by endless belt conveyor 44, in the direction of arrow 43, to fusing station E.

Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as registration rollers 24 and 26, to catch tray 54.

Invariably, after the copy sheet is separated from photoconductive surface 12, some residual toner particles remain adhering thereto. These toner particles are removed form photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine. Referring now to the specific subject matter of the present invention, FIG. 2 depicts the friction retard feeder system in greater detail.

Figure 2:
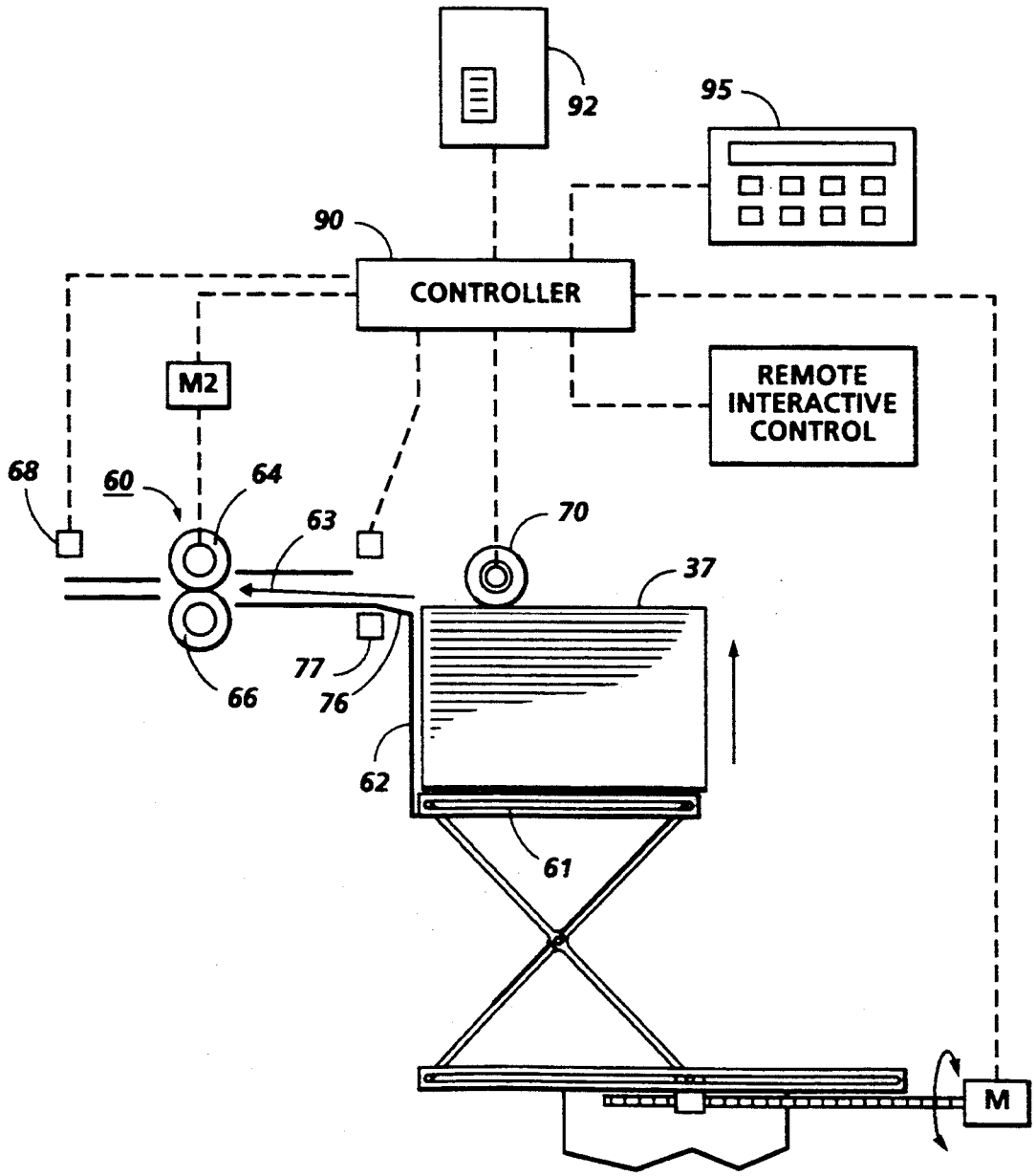
FIG. 2 is an enlarged plan view of the friction retard feeder roll wear compensating apparatus of the present invention shown in FIG. 1.

Referring now to FIG. 2, the detailed structure and operation of the friction retard feeder system will be described where friction retard feeder 60 includes a nudger roll 70 positioned above sheets 36 stacked on platform 61 that has a sheet retaining wall 62 attached thereto. The platform or sheet support 61 is movable incrementally to lift sheets 37 by a conventional motor M. Sheets are fed from a platform or tray 61 as required by nudger roll 70 to feed roll 64 and nip 66 and platform 61 is incrementally moved upwardly by the conventional motor as sheets are fed from the stack, thereby increasing the normal force of nudger roll 70 on the top sheet of the stack for continued feeding. As use of the feeder continues over a period of time, feed roll 64, retard roll 66 and nudger roll 70 will wear to a point that the surface speed of each roll increases. If the wear rates of each of the rolls is different, the roll speeds will not be the same which will cause the sheets to buckle or tear as they are fed through the friction retard feeder system. Depending on the amount of speed mismatch, misfeed can occur as well. In addition, if the nudger roll wears incremental adjustment of the elevator connected to platform 61 must occur to prevent misfeeds.

In general, a sheet feeder system constructed and operated according to the present invention may detect and respond to an abnormal operating condition, such as, misfeeds in the following manner. Again referring to FIG. 2 and in addition the FIG. 3 flow diagram, in response to an operator's initiating operation at 100 of the machine from console 95, a microprocessor controller 90 signals the sheet feeder device and nudger roll 70 to feed a sheet 37 off the sheet stack toward the sheet path shown by arrow 63. The microprocessor controller may comprise, for example, an 8085-type controller or any functionally similar device. Instructions may be hard-coded on the device, but more commonly the device will comprise an EPROM (Erasable Programmable Read Only Memory) device to more readily accommodate software upgrades. The microprocessor controller then monitors the sensor 77 downstream of the nudger roll 70 to determine the time the leading edge of the sheet 37 reaches the sensor 77 with the length of time being measured from the initiation of sheet feeding. The sheet is forwarded by the nudger roll into the nip formed between feed roll 64 and retard roll 66 which in turn forwards the sheet into the imaging portion of the copier/printer 10. Feed roll wear and contamination is a significant problem with friction retard feeders. One attempt at extending feed roll life is through the use of different materials other than, e.g., isoprene, but these rolls too degrade an unacceptable amount over a short period of time. Also, feed rolls with a high wear rate can be used to reduce contamination problems by constantly providing a fresh elastomer surface to the sheet. By allowing the machine to adjust to different roll diameters, the time between roll replacement can be extended greatly. A more detailed description of this self-correction process is provided below with respect to FIG. 3.

Figure 3:
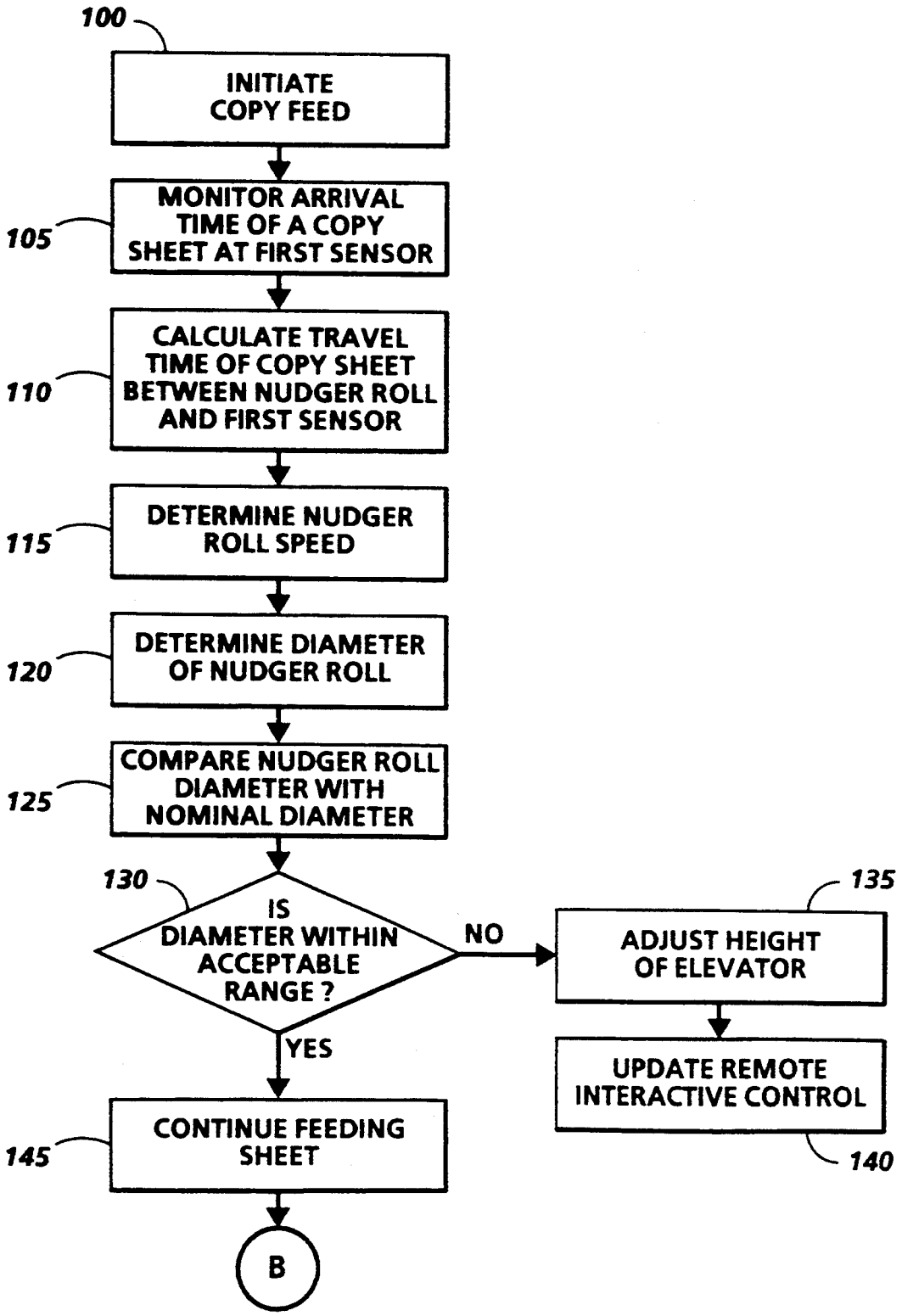
FIG. 3 shows an algorithm for compensating for wear of a nudger roll according to the present invention.
Figure 4:
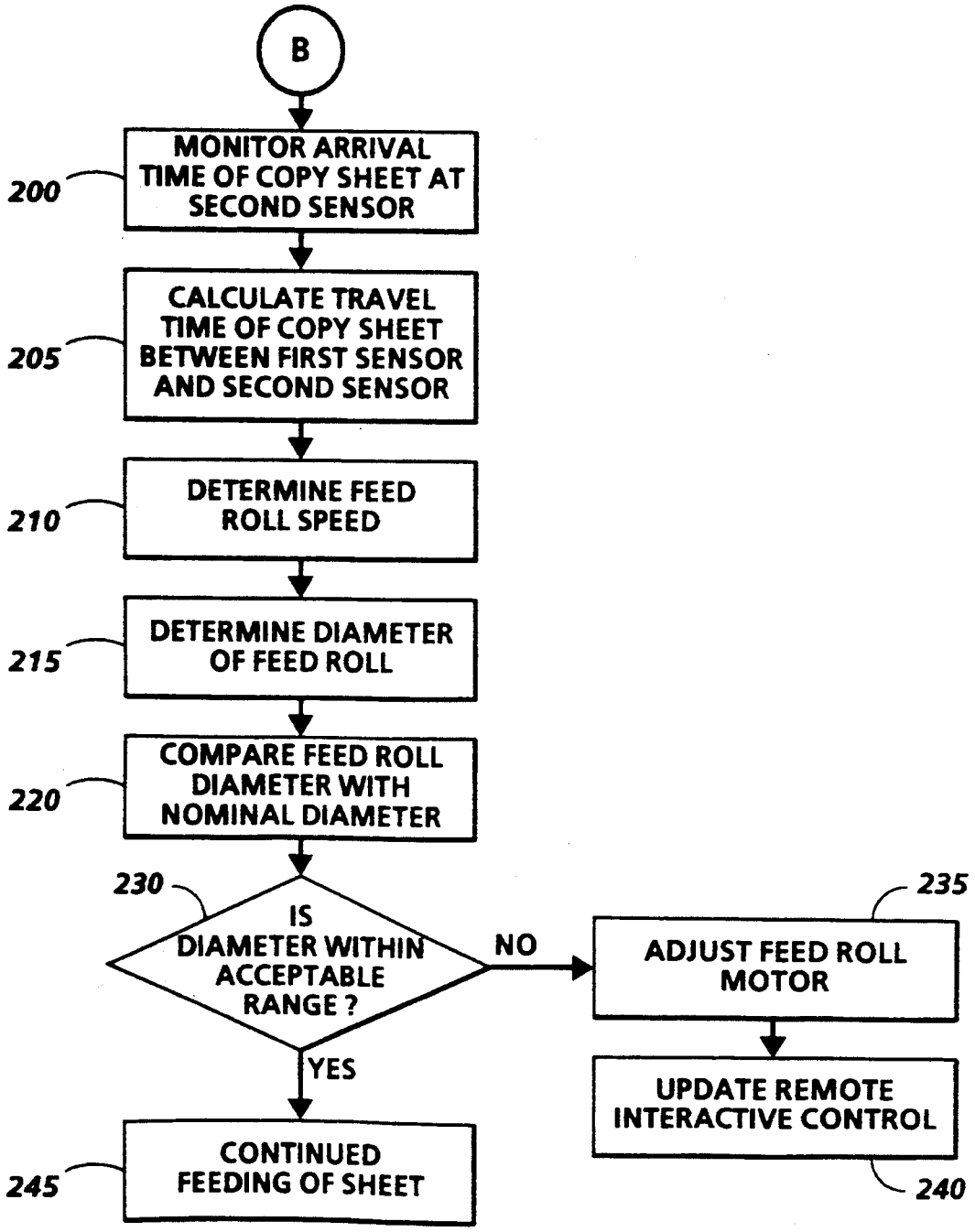
FIG. 4 shows an algorithm for compensating for wear of a feed roll according to the present invention.

FIGS. 3 and 4 show a flow diagrams illustrating the operation of a sheet feeder system operated according to the present invention. With respect to nudger roll 70 and FIG. 3, processing begins when an operator initiates a photocopying session on console 95 In step 100, for example, by pressing a "Copy" button. Controller 90 for the photocopying machine measures at step 105 the arrival time of the lead edge of a copy sheet at sensor 77 and calculates in step 110 the time of travel of the sheet between an initial position of the sheet which is known and sensor 77. From this the nudger roll speed is determined in step 11 5. The diameter of nudger roll 70 is calculated in step 120 and the amount of wear of the nudger roll is compared in step 125 with diameters contained in lookup table 92 and based on the comparison between the estimated diameter of the nudger roll and the nominal diameter in the lookup table, a signal is sent by controller 90 when the diameter of the nudger roll is outside a nominal diameter to adjust the nominal height of elevator 61 through motor M in step 135 and thereby increase the normal force of the nudger roll against the copy sheet stack. This wear information is also sent to a remote interactive communication system in step 140 to alert field service when field service on the machine 10 is required while the sheet continues to be fed in step 145.

Feed roll wear and contamination Is a significant problem with friction retard feeders. The isoprene roll used in these feeders breaks down when exposed to ozone and light. Different feed materials, which do not contaminate as quickly or degrade due to the environment will help to extend the roll life. But, by allowing the machine to adjust to different roll diameters, the time between roll replacement can be extended greatly. Also, a large range of roll diameters will function in the feeder when wear compensation adjustments are possible, thereby allowing the use of oversized and undersized rolls. As seen in FIG. 4, wear compensation adjustment for feed roll 64 begins when an operator initiates a photocopying session on console 95 at 100 as shown in FIG. 3, for example, by pressing a "Copy" button. Adaptive controller 90 for the photocopying machine measures at 200 the arrival time of the lead edge of a copy sheet at sensor 68 and calculates the time of travel of the sheet between an initial position of the sheet which is known from the sheet being sensed at sensor 77 and sensor 68 in step 105. From this the feed roll speed is determined in step 210. The diameter of feed roll 64 is calculated in step 215 and the amount of wear of the feed roll compared in step 220 with diameters contained in lookup table 92 and based on the comparison between the estimated diameter of the feed roll and the nominal diameter in the lookup table, a signal is sent in step 230 by controller 90 when the diameter of the feed roll is outside a predetermined range to adjust the speed of motor M2 to match the feed roll surface speed to that of other rolls in the paper path as seen in step 235. This feed roll wear information is also sent to a remote interactive communication system in step 240 to alert field service when field service on the machine 10 is required as the sheet is fed through the paper path of the machine in step 245.

Examples of photocopying machines to which the present invention is particularly suited include the Xerox Model 5046, Xerox Model 5028, and Xerox Model 5034. It should be noted that these examples are merely offered for illustration, as the present invention may be applied in many different types of photocopying machines.

In conclusion, an adjustable nudger roll normal force apparatus and feed roll speed adjustment apparatus of a friction retard feeder is disclosed which measures the surface speed of the nudger roll and feed roll by the use of sensors that detect the position of a moving sheet and a controller that calculates the reduction in the diameter of each roll due to wear and in the case of the nudger roll causes a sheet stack holding elevator to rise in order to maintain a constant force of the sheets, thereby avoiding reliability problems and misfeeds due to wear. Based on its diameter, feed roll speed is adjusted by the controller to match that of other rolls in the paper path in order to prevent the sheets from moving too slowly and tearing. Advantages of this roll wear compensation system include the extension or roll life by increasing the range of acceptable roll diameters; reduction of misfeeds and jams by preventing buckling and tearing; preventing misfeeds due to low nudger roll force; prevention of unscheduled maintenance calls for roll wear due to roll wear data being furnished to remote interactive control station.

It should be understood that the roll wear compensation system disclosed herein could be used in any system that feeds sheets with rolls and not just with a friction feed system shown herein as the preferred embodiment.

It is, therefore, evident that there has been provided in accordance with the present invention a roll wear compensation system for use in sheet feeders which fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. A roll wear compensation system for use in a friction retard feeder that feeds copy sheets from a stack, comprising:

a nudger roll and a feed roll, said feed roll forming a nip with a retard roll;

a motor for driving said nudger roll and feed roll;

an elevator adapted to maintain normal force of said nudger roll against the sheet stack;

a first sensor positioned downstream of said nudger roll and upstream of said feed roll and second a sensor downstream of said feed roll for signaling the arrival time of a copy sheet at each of said first and second sensors; and a controller for calculating the time of travel of the copy sheet between said nudger roll and said first sensor and between said first sensor and said second sensor, measuring the diameter of both said nudger roll and said feed roll, comparing said measured diameters of said nudger roll and said feed roll with nominal diameters stored in a lookup table, and adjusting the nominal height of said elevator when the diameter of said nudger roll is less than a predetermined diameter and adjusting the roll speed of said feed roll when the diameter of said feed roll is less than a predetermined diameter in order to minimize sheet misfeeds and prevent tearing of copy sheets during transport through a paper path.

2. The roll wear compensation system of claim 1, wherein said controller signals a remote interactive control station when roll wear is indicated.

3. A method of compensating for roll wear in a feeder system that feeds sheets from a stack, comprising:

providing a nudger roll positioned above and in contact with the sheet stack and a feed roll for driving the sheets received from said nudger roll into a paper path;

providing a motor for driving said nudger roll and feed roll;

providing an elevator to support the sheet stack and maintain normal force of said nudger roll against the sheet stack;

providing a first sensor positioned downstream of said nudger roll and upstream of said feed roll and a second sensor downstream of said feed roll for signaling the arrival time of a sheet at each of said first and second sensors; and measuring the arrival time of the lead edge of the sheet at said first sensor and at said second sensor;

calculating travel time of the sheet between said nudger roll and said first sensor and between said first sensor and said second sensor;

determining the roll speed of said nudger roll and said feed roll;

calculating the roll diameter of said nudger roll and said feed roll;

comparing the roll diameter of said nudger roll and said feed roll with nominal roll diameters; and adjusting the nominal height of said elevator when the diameter of said nudger roll is less than the nominal diameter and adjusting said motor and thereby the roll speed of said feed roll when the diameter of said feed roll is less than the nominal diameter in order to minimize sheet misfeeds and prevent tearing of copy sheets during transport through the paper path.

4. In a reproduction system adapted to make copies of page image information by transferring the page image information to copy sheets fed from a copy sheet feeder, the improvement of roll wear compensation in the copy sheet feeder characterized by:

a nudger roll and a feed roll, said feed roll forming a nip with a retard roll;

a motor for driving said nudger roll and feed roll;

an elevator adapted to maintain normal force of said nudger roll against the sheet stack;

a first sensor means positioned downstream of said nudger roll and upstream of said feed roll and a second sensor downstream of said feed roll for signaling the arrival time of a copy sheet at each of said first and second sensor means; and a controller for calculating the time of travel of the copy sheet between said nudger roll and said first sensor and between said first sensor and said second sensor, measuring the diameter of both said nudger roll and said feed roll, comparing said measured diameters of said nudger roll and said feed roll with nominal diameters stored in a lookup table, and adjusting the nominal height of said elevator when the diameter of said nudger roll is less than a predetermined diameter and adjusting the roll speed of said feed roll when the diameter of said feed roll is less than a predetermined diameter in order to minimize sheet misfeeds and prevent tearing of copy sheets during transport through a paper path.

* * * * *